US011482810B2

(12) United States Patent
Pemwieser et al.

(10) Patent No.: US 11,482,810 B2
(45) Date of Patent: Oct. 25, 2022

(54) SECONDARY SECURING MEANS, ELECTRICAL PLUG CONNECTOR AND ELECTRICAL PLUG CONNECTION

(71) Applicant: Rosenberger Hochfrequenztechnik GmbH & Co. KG, Fridolfing (DE)

(72) Inventors: Manuel Pemwieser, Tittmoning (DE); Christian Maier, Griesstaett (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 17/225,343

(22) Filed: Apr. 8, 2021

(65) Prior Publication Data

US 2021/0242627 A1 Aug. 5, 2021

Related U.S. Application Data

(63) Continuation of application No. PCT/EP2019/075589, filed on Sep. 24, 2019.

(30) Foreign Application Priority Data

Oct. 9, 2018 (DE) ..... 10 2018 124 876.8

(51) Int. Cl.
*H01R 13/639* (2006.01)
*H01R 13/627* (2006.01)

(52) U.S. Cl.
CPC ..... *H01R 13/6275* (2013.01); *H01R 13/6272* (2013.01); *H01R 13/639* (2013.01); *H01R 2201/26* (2013.01)

(58) Field of Classification Search
CPC ..... H01R 13/6275; H01R 13/6272; H01R 13/639; H01R 13/6397; H01R 2201/26
See application file for complete search history.

(56) References Cited

U.S. PATENT DOCUMENTS 5,220,815 A * 6/1993 Davidge ..... H01R 13/447 70/168
5,573,412 A * 11/1996 Anthony ..... H01R 13/6397 220/242

(Continued)

FOREIGN PATENT DOCUMENTS

DE 10 2007 046 591 A1 4/2009
DE 102018200425 A1 * 7/2019

*Primary Examiner* — Tho D Ta
(74) *Attorney, Agent, or Firm* — Donald S. Showalter, Esq.; GrayRobinson, P.A.

(57) ABSTRACT

A secondary securing means for locking an electrical plug connection of a first electrical plug connector and a mating plug connector includes a securing element and a plug-in prevention means. By a closing movement, the securing element can be moved from a preliminary latching position into a locking position in which the securing element mechanically secures the plugged plug connection. The securing element is operatively connected to the plugging prevention means in such a way that, during the closing movement of the securing element, the plug-in prevention means can be moved from a home position in which the plugging prevention means blocks a complete insertion of the mating plug connector into the first plug connector, to a clearing position in which the plug-in prevention means clears the displacement path between the mating plug connector and the first plug connector complete insertion of the mating plug connector into the first plug connector The plug-in prevention means moving from the home position into the clearing position by rotation about an axis of rotation or along a support element.

16 Claims, 5 Drawing Sheets

(56) References Cited

U.S. PATENT DOCUMENTS

| | | | | |
|---|---|---|---|---|
| 5,827,086 | A | 10/1998 | Fukuda | |
| 9,071,020 | B2 * | 6/2015 | Temmesfeld | B60L 53/16 |
| 9,425,534 | B2 * | 8/2016 | Schmidt | H01R 13/521 |
| 2006/0014413 | A1 | 1/2006 | Annecke | |
| 2009/0130902 | A1 | 5/2009 | Hall et al. | |
| 2017/0054252 | A1 * | 2/2017 | Gates | H01R 13/6397 |
| 2017/0214181 | A1 * | 7/2017 | Tsay | H01R 13/6397 |
| 2018/0076571 | A1 * | 3/2018 | Tsay | H01R 13/443 |

* cited by examiner

SECONDARY SECURING MEANS, ELECTRICAL PLUG CONNECTOR AND ELECTRICAL PLUG CONNECTION

CROSS REFERENCE TO RELATED APPLICATIONS

This is a continuation of International Application No. PCT/EP2019/075589 filed Sep. 24, 2019 entitled SECONDARY SECURING MEANS, ELECTRICAL PLUG CONNECTOR AND ELECTRICAL PLUG CONNECTION which designates the United States and at least one other country in addition to the United States and claims priority to German Patent Application No. 10 2018 124 876.8 filed Oct. 9, 2018. Priority to PCT/EP2019/075589 filed Sep. 24, 2019 entitled SECONDARY SECURING MEANS, ELECTRICAL PLUG CONNECTOR AND ELECTRICAL PLUG CONNECTION is hereby claimed under 35 U.S.C. § 120. Priority to German Patent Application No. 10 2018 124 876.8 filed Oct. 9, 2018 is hereby claimed under 35 U.S.C. § 119.

INCORPORATION BY REFERENCE

International Application No. PCT/EP2019/075589 and German Patent Application No. 10 2018 124 876.8 are each expressly incorporated herein by reference in their entiteties to form part of the present disclosure.

STATEMENT REGARDING FEDERALLY-SPONSORED RESEARCH DEVELOPMENT

Not applicable.

FIELD OF INVENTION

The invention relates to a secondary securing means for locking an electrical plug-in connection consisting of an electrical plug-in connector and an electrical mating plug-in connector. A further aspect of the invention relates to an electrical plug-in connector for connection to an electrical mating plug-in connector, having a housing and a plug-in prevention means and yet another aspect of the invention relates to an electrical plug-in connection.

BACKGROUND

When manufacturing cables, their conductors are typically connected to a plug-in connector in order to be able to subsequently establish electrical connections with other cables or conductors which have corresponding plug-in connectors or mating plug-in connectors. A plug-in connector or mating plug-in connector may be a plug, a built-in plug, a socket, a coupling or an adapter. The term "plug-in connector" or "mating plug-in connector" used within the scope of the invention is representative of all variants.

Exacting requirements in respect of their robustness and the security of the plug-in connections are imposed in particular on plug-in connectors for the automotive industry or for vehicles. Therefore, a plug-in connection has to withstand sometimes high loads, for example mechanical loads, and remain closed in a defined manner, so that the electrical connection is not unintentionally disconnected, for example during operation of a vehicle. The guarantee of security is paramount in particular in the case of autonomous operation of vehicles and for driver assistance systems.

A so-called secondary securing means is generally used in practice in order to secure the plugged-in state of the electrical plug-in connection consisting of a plug-in connector and a mating plug-in connector. The known secondary securing means can generally be moved between a preliminary latching position and a locking position, wherein a securing element of the secondary securing means mechanically secures the plug-in connection in the locking position.

It is also known from practice that the secondary securing means has, in addition to the securing element, a so-called plug-in prevention means which blocks insertion of the mating plug-in connector into the plug-in connector in a form-fitting manner in a home position and clears the displacement path for plugging together the plug-in connection in a clearing position. Unintentional and possibly resulting incomplete insertion of the mating plug-in connector into the plug-in connector can be prevented in this way.

In this case, the known secondary securing means are designed such that they can be pushed in by a user, for example a fitter of the plug-in connection, along a straight, linear movement orthogonally to an insertion direction of the mating plug-in connector into the plug-in connector. Owing to this linear displacement, the securing element is moved to the locking position and there latches in an intended latching position. Owing to the linear movement, the plug-in prevention means is also moved out of the displacement path of the mating plug-in connector.

However, in practice, the use of a secondary securing means of this kind is limited to plug-in connectors or plug-in connections of which the interface provides enough space for the displacement of the plug-in prevention means inward into the plug-in connector. This condition is inconsistent with the increasing requirement to design the plug-in connections in a compact and space-saving manner.

A further problem arises when the displacement path for the plug-in prevention means in the interior space of the plug-in connector or in its interface is blocked in some other way. In order to ensure a high degree of process reliability of the plug-in connections, it is sometimes necessary to ensure that no mechanical damage to (for example deformation or fracture of) contact elements can take place even when the mating plug-in connector and the plug-in connector are brought together at an angle. In order to prevent such damage and ensure the so-called "Koshiri security", at least one contact element, in particular the external conductor, is generally formed as Koshiri rings or surrounded by a Koshiri ring. A Koshiri ring in the interface of the plug-in connector naturally protrudes comparatively far forward, as a result of which the displacement path for a plug-in prevention means may be blocked.

BRIEF SUMMARY OF THE INVENTION

The present invention is based on the object of providing a secondary securing means for locking an electrical plug-in connection, which secondary securing means can be used in a variable manner for a large number of types of plug-in connector, in particular for compact electrical plug-in connectors and plug-in connectors which have a Koshiri ring.

The present invention is further based on the object of providing an electrical plug-in connector and an electrical plug-in connection, which plug-in connector and plug-in connection have an improved plug-in prevention means which can also be used, in particular, in combination with a Koshiri ring.

The secondary securing means according to the invention for locking an electrical plug-in connection consisting of an electrical plug-in connector and an electrical mating plug-in connector has a securing element and a plug-in prevention means. The securing element can be moved, by a closing movement, from a preliminary latching position to a locking position in which the securing element mechanically secures the plugged-in plug-in connection.

In this case, the securing element can preferably be designed in order to mechanically secure a housing of the plug-in connector to an external conductor of the plug-in connector. For this purpose, the securing element can have, for example, at least one latching hook or at least one latching lug which latch to the housing of the plug-in connector. In addition or as an alternative, the securing element can have one or more partial ring-like projections, webs, fingers or other protrusions which can be inserted into corresponding grooves or recesses of the housing of the plug-in connector. However, the manner of mechanical securing by the securing element is not important in principle, but the abovementioned variant is the preferred embodiment of the invention.

The securing element or the secondary securing means can be fastened to the electrical plug-in connector in a captive manner in the preliminary latching position, for example by way of one or more latching lugs being latched in a housing of the plug-in connector. Therefore, the secondary securing means can be secured, in particular, against being accidentally pulled out. In this case, the electrical plug-in connector may advantageously be supplied, for example, together with the secondary securing means.

A captive connection of the securing element or the secondary securing means to the plug-in connector is advantageous, but not absolutely necessary within the scope of the invention.

The preliminary latching position may also be only one position in which the secondary securing means or the securing element is not yet latched to the plug-in connector, that is to say a position before latching.

According to the invention, provision is made for the securing element to be operatively connected to the plug-in prevention means in such a way that the plug-in prevention means can be moved, during the closing movement of the securing element, from a home position, in which the plug-in prevention means blocks complete insertion of the mating plug-in connector into the plug-in connector, to a clearing position, in which the plug-in prevention means clears the displacement path between the mating plug-in connector and the plug-in connector for complete insertion of the mating plug-in connector into the plug-in connector.

The securing element and the plug-in prevention means can be operatively connected, for example, in such a way that the plug-in prevention means is located in the displacement path of the securing element and therefore is mechanically contacted by the securing element during the closing movement of the securing element and therefore is operated or displaced. As an alternative, provision can also be made for the securing element and the plug-in prevention means to be formed in one piece or to be mechanically directly connected to one another, as a result of which a movement, in particular operation of the securing element by a user, can be directly transmitted to the plug-in prevention means.

A plug-in prevention means, which blocks insertion of the mating plug-in connector into the plug-in connector when the secondary securing means is not in a final latching position, can advantageously be provided.

According to the invention, provision is made for the plug-in prevention means to be able to be moved in a rotational manner from the home position to the clearing position via a rotation axis or along a supporting element.

As a result of the plug-in prevention means not being moved in a straight line or linearly from the home position to the clearing position, but rather in a rotational manner, an electrical plug-in connector which has the secondary securing means can be particularly compact. In order to clear the displacement path, the plug-in prevention means can be pivoted out of the interface or interior space of the plug-in connector in a rotational manner, instead of being pushed deeper into the interior space or pushed through the interior space. As a result, the plug-in prevention means can be used largely independently of the design of the interior space of the plug-in connector and the size and configuration of the interface of the plug-in connector are no longer important.

Furthermore, the secondary securing means according to the invention may also advantageously be usable with an electrical plug-in connector, the external conductor of which protrudes particularly far forward in the plug-in connector (in the direction of the mating plug-in connector), and/or for plug-in connectors which have a so-called Koshiri ring.

However, the invention is also advantageously suitable as an alternative to the existing plug-in prevention means, in particular compact plug-in prevention means, even if there is no Koshiri ring provided in the plug-in connector. In principle, the invention may be suitable for use with any desired plug-in connectors.

Provision can be made for the securing element to have an operating element or an operating area, by way of the operation of which a user, for example a fitter of the plug-in connection, can initiate the closing movement.

In an embodiment of the invention, provision can be made for the closing movement to be a linear movement.

A linear closing movement can be initiated in a particularly simple and reliable manner by the user or fitter of the plug-in connection. Furthermore, a linear closing movement due to interaction between the securing element and the electrical plug-in connector can be implemented in a comparatively simple manner, for example by way of a rail guide of the securing element being provided in the plug-in connector.

In an embodiment, provision can also be made for the closing movement of the securing element to run orthogonally to an insertion direction of the plug-in connection.

The insertion direction may be the movement vector along which the mating plug-in connector is inserted into the plug-in connector in order to close the electrical plug-in connection.

An orthogonal closing movement of the securing element can firstly be implemented in a technically advantageous manner and secondly ensure particularly robust mechanical securing of the closed plug-in connection.

In an embodiment of the invention, provision can be made for the plug-in prevention means to be able to be moved radially outward from a center axis of the plug-in connector in order to clear the displacement path.

In particular, provision can be made for the plug-in prevention means, in its home position, to protrude by way of at least one first (front) end at least partially into the interior of the plug-in connector and to be moved out, i.e. pivoted out, of the interior of the plug-in connector to the clearing position by the rotational movement.

The invention also relates to an electrical plug-in connector for connection to an electrical mating plug-in connector, having a housing and a plug-in prevention means which is designed in order to block complete insertion of the mating plug-in connector into the plug-in connector in a home position and to clear the displacement path between the mating plug-in connector and the plug-in connector for complete insertion of the mating plug-in connector into the plug-in connector in a clearing position.

In the electrical plug-in connector according to the invention, provision is made for the plug-in prevention means to be able to be moved in a rotational manner from the home position to the clearing position via a rotation axis or along a supporting element.

In an embodiment, provision can be made for the plug-in prevention means to form, together with a securing element, a secondary securing means for locking an electrical plug-in connection consisting of the plug-in connector and the mating plug-in connector.

Therefore, a component which advantageously combines the functions of a mechanical securing means of the plug-in connection and a plug-in prevention means can be provided. The secondary securing means or the securing element of the secondary securing means can be plugged into the electrical plug-in connector in the preliminary latching position or in the locking position or the end position. In the preliminary latching position, the plug-in prevention means belonging to the secondary securing means can block insertion of the mating plug-in connector into the plug-in connector in a form-fitting manner.

In the locking position or the end position of the secondary securing means or the securing element, the plug-in prevention means can be displaced out of the plug-in connector in a rotational manner and therefore allow the plug-in process.

In an embodiment of the invention, provision can be made for the plug-in connector to comprise an electrical external conductor which preferably has a Koshiri ring.

A Koshiri ring can prevent damage to easily deformable contact elements. The use of Koshiri rings for ensuring the Koshiri security is known in the prior art, and therefore the details will not be discussed any further.

In this case, the invention is particularly suitable for use with a Koshiri ring since said Koshiri ring in the electrical plug-in connector generally protrudes comparatively far forward in the axial direction, as a result of which a linear movement of the plug-in prevention means in the radial direction deeper into the interface for clearing the plug-in prevention means is generally not possible or not readily possible.

A Koshiri wall, which can be employed in particular in the case of external conductor contacts with rectangular cross-sectional profiles, can also be provided instead of a Koshiri ring.

In an embodiment of the invention, provision can also be made for the plug-in prevention means to be designed and arranged in order to be supported on the external conductor in the home position, in which the plug-in prevention means blocks insertion of the mating plug-in connector into the plug-in connector.

As a result of the plug-in prevention means initially being supported on the external conductor, the plug-in prevention means can particularly securely block insertion of the mating plug-in connector into the plug-in connector. Owing to the plug-in prevention means being supported on the external conductor, in particular on an external conductor Koshiri ring, the resistance which can be applied by the plug-in prevention means increases in order to prevent undesired insertion of the mating plug-in connector.

In an embodiment, provision can be made for the rotation axis to be formed by a rotary joint of the housing of the plug-in connector.

Therefore, the securing element can also be attached to the housing of the plug-in connector or formed in one piece with the plug-in connector.

In particular, the plug-in prevention means can be formed, together with the rotary joint, in the manner of a rocker. In this case, a first (front) end of the rocker can, in the home position, protrude into the interface of the plug-in connector and block the displacement path of the mating plug-in connector into the plug-in connector. A second (rear) end of the rocker can finally be arranged in the displacement path of the securing element in such a way that the securing element, during the closing movement, operates the second end of the rocker and in this way pivots the first end of the rocker out of the interface of the plug-in connector at least to such an extent that the displacement path is cleared.

In an embodiment, provision can further be made for the rotation axis to run parallel or orthogonally to an insertion direction of the mating plug-in connector into the plug-in connector.

Both arrangements allow the plug-in prevention means to pivot out of the displacement path.

The rotation axis preferably runs orthogonally to the insertion direction.

In an alternative embodiment of the invention, provision can be made for the plug-in prevention means to have a stop head for blocking the mating plug-in connector and a deformable spring arm, preferably an elastic spring arm, which extends from the stop head in the direction of the supporting element.

The stop head can be mechanically reinforced, in particular, with respect to the spring arm and therefore be designed, in particular, to absorb forces, which act on the plug-in prevention means in the insertion direction of the mating plug-in connector, less deformably or less elastically than the spring arm. The stop head and the spring arm can also be produced from different materials in order to provide the different elasticity properties and, respectively, the desired deformability.

In principle, a finger, a stop head or another protrusion of the plug-in prevention means can protrude into the interface of the plug-in connector in order to ensure that the mating plug-in connector cannot be completely inserted into the plug-in connector if the secondary securing means is not in its locking position.

The deformability or the elasticity of the spring arm can be selected in such a way that the spring arm can be sufficiently reversibly bent for the required rotational movement or the pivoting of the stop head out of the displacement path, without undergoing (irreversible) plastic deformation.

In an embodiment of the invention, provision can be made for the supporting element to be formed by an edge of a recess in the housing of the plug-in connector.

The recess can be, in particular, a recess through which the plug-in prevention means or at least the stop head can be inserted into the plug-in connector in order to block insertion of the mating plug-in connector.

In an embodiment of the invention, provision can be made for the spring arm to be supported on the edge of the recess.

Therefore, the rotational movement of the plug-in prevention means can be provided, in particular, by the combination of an edge with the deformable or the elastic spring arm when the end of the spring arm which is averted from the stop head is moved.

For example, the securing element can be mechanically directly connected to the stop head or the front end of the plug-in prevention means, which front end protrudes into the displacement path, via the spring arm, for example can be connected in one piece. Therefore, if the securing element is moved from the preliminary latching position linearly to the locking position, this linear movement can be transferred into a rotational movement of the stop head via the spring arm which is supported on the edge, as a result of which the stop head or the front end is pivoted out of the displacement path by deformation of the spring arm.

In an embodiment of the invention, a primary securing means can be provided in order to mechanically secure the connection between the plug-in connector and the mating plug-in connector.

The primary securing means may be, in particular, one or more latching hooks which accordingly engage behind corresponding edges when the plug-in connection is closed.

The secondary securing means can mechanically secure the plug-in connection in any desired manner, and the secondary securing means preferably secures the housing of the plug-in connector to the external conductor of the plug-in connector.

The invention also relates to an electrical plug-in connection, having an electrical plug-in connector according to the above and the following embodiments and an electrical mating plug-in connector for connection to the plug-in connector.

The plug-in connection can have a secondary securing means which comprises a securing element for mechanically securing the plug-in connection and a plug-in prevention means.

The plug-in prevention means can be pivoted out of the interface or out of the interior of the plug-in connector in a rotational manner, and in this way clear the interface for the mating plug-in connector, by means of deflection owing to the positioning of the secondary securing means or the securing element in its locking position.

In contrast to the known prior art in which the secondary securing means or the securing element and at the same time also the plug-in prevention means are guided linearly inward into the plug-in connector, the present rotational movement of the plug-in prevention means can be used in a flexible manner for virtually any desired plug-in connectors since the interface or the inner construction of the plug-in connector is not important.

A plug-in prevention means shaped in the form of a blade arm can be fastened in a rotationally elastic manner to the secondary securing means or to its securing element. In the non-loaded state, the plug-in prevention means can be located in the insertion path of the mating plug-in connector and therefore block the plug-in process. If the secondary securing means or its securing element is moved to the locking position, the blade arm-like plug-in prevention means can be rotated about a rotation center by a stop on the housing of the plug-in connector, as a result of which it can move out of the insertion path of the mating plug-in connector. The plug-in process can be enabled in this way.

The blade arm-like plug-in prevention means can also be fastened in a rotationally elastic manner to the housing of the plug-in connector. In the non-loaded state, the plug-in prevention means can be located in the insertion path of the mating plug-in connector and therefore block the plug-in process. If the secondary securing means or its securing element is moved to the locking position, the blade arm-like plug-in prevention means can be rotated about its rotation center by the secondary securing means. The plug-in process can also be enabled in this way.

The plug-in connector according to the invention or the plug-in connection according to the invention can advantageously be provided for transmitting large quantities of data. In particular, use in the automotive sector can be provided, for example for transmitting high-bit-rate data signals relating to autonomous driving, driver assistance systems, navigation, infotainment, the transmission of data of a plurality of cameras, sensors or screens.

The electrical plug-in connection can preferably be designed as a FAKRA plug-in connection or HFM (High-Speed FAKRA-Mini) plug-in connection. However, the electrical plug-in connection can be designed in any desired manner in principle. The use of the secondary securing means is advantageously possible for a large number of plug-in connectors.

Features which have already been described in connection with the secondary securing means and the electrical plug-in connector can, of course, also be advantageously implemented for the electrical plug-in connection and vice versa. Furthermore, advantages which have already been mentioned in connection with the secondary securing means or the electrical plug-in connector can also be understood to relate to the electrical plug-in connection and vice versa.

In addition, it should be noted that terms such as "comprising", "having" or "with" do not preclude any other features or steps. Furthermore, terms such as "a" or "the" which refer to a singular step or feature do not preclude several features or steps and vice versa.

Exemplary embodiments of the invention are described in more detail below with reference to the drawing.

The figures of the drawings show preferred exemplary embodiments in which individual features of the present invention are illustrated in combination with one another. Features of one exemplary embodiment can also be implemented separately from the other features of the same exemplary embodiment and can accordingly be readily combined by a person skilled in the art with features of other exemplary embodiments to form further expedient combinations and subcombinations.

In the figures drawings, elements having an identical function are provided with the same reference symbols.

DETAILED DESCRIPTION OF THE PREFERRED EMBODIMENTS

Figure 1:
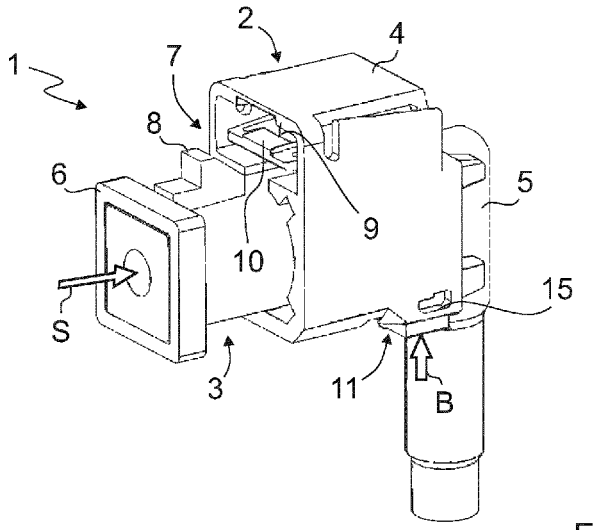
FIG. 1 is a perspective illustration of the electrical plug-in connection according to the invention in an as yet not closed state, having an electrical plug-in connector and an electrical mating plug-in connector.
Figure 2:
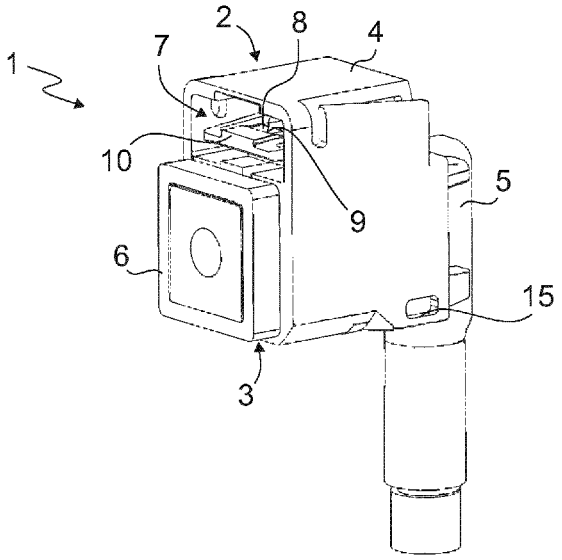
FIG. 2 is a perspective illustration of the electrical plug-in connection of FIG. 1 in a closed state.

FIGS. 1 and 2 show an electrical plug-in connection 1 according to the invention in a partially plugged-in state (compare FIG. 1) and in a plugged-in state (compare FIG. 2). The electrical plug-in connection 1 has an electrical plug-in connector 2 and an electrical mating plug-in connector 3 for connection to the plug-in connector 2.

The electrical plug-in connector 2 has a housing 4 and an external conductor 5 which is accommodated in the housing 4. The external conductor 5 surrounds an electrical internal conductor which is guided in the external conductor 5 and is electrically insulated from the external conductor 5 by means of a dielectric. However, this is not important in the context of the invention, and therefore the internal conductor and the dielectric are not shown in the exemplary embodiment for simpler illustration of the invention. The external conductor 5 and the internal conductor or the electrical plug-in connector 2 (and also the electrical mating plug-in connector 3) can further be connected to an electric cable, an electrical printed circuit board or another electrical module (likewise not illustrated).

The electrical mating plug-in connector 3 likewise has a housing 6, wherein the housing 4 of the electrical plug-in connector 2 and the housing 6 of the electrical mating plug-in connector 3 are designed in such a way that they can be inserted one into the other.

In the exemplary embodiment, a primary securing means 7 is provided for securing the plug-in connection 1, which primary securing means is formed by a latching hook 8 on the housing 6 of the mating plug-in connector 3, which latching hook can engage behind a corresponding edge 9 of a latching element 10 on the housing 4 of the plug-in connector 2 and in this way secures the electrical plug-in connection 1 from being pulled out in the closed state.

Figure 3:
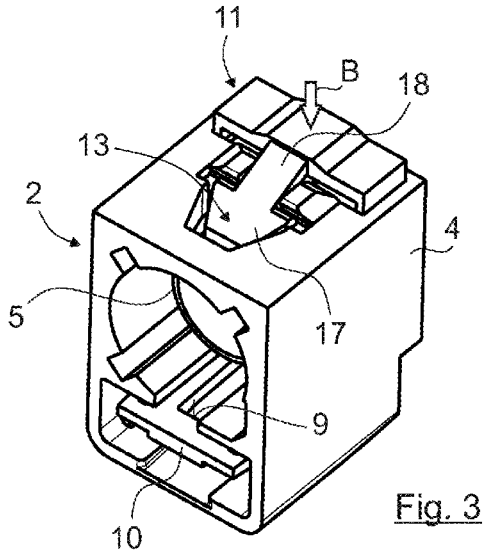
FIG. 3 is a perspective illustration, rotated through one hundred eighty degrees (180°) with respect to FIGS. 1 and 2, of the electrical plug-in connector according to the invention with a secondary securing means in a preliminary latching position.
Figure 8:
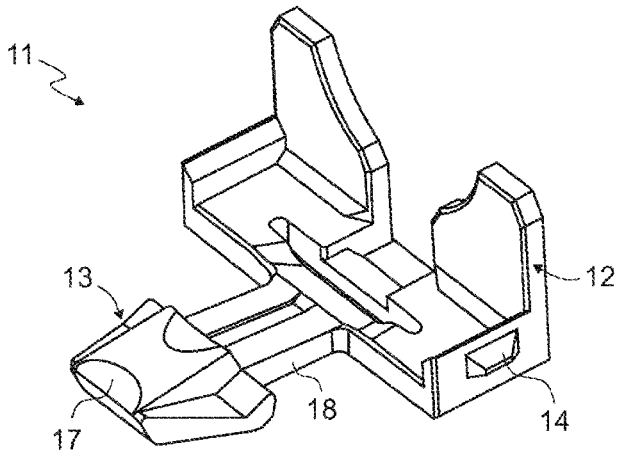
FIG. 8 is a separate perspective illustration of the secondary securing means illustrated in FIGS. 3 to 7.

FIG. 3 illustrates the electrical plug-in connector 2 of FIGS. 1 and 2 separately in a view from below and without the external conductor 5. The electrical plug-in connector 2 has a secondary securing means 11 for locking the plug-in connection 1. The secondary securing means 11 comprises a securing element 12 and a plug-in prevention means 13 (compare FIG. 8 in particular).

In the exemplary embodiment, the securing element 12 of the secondary securing means 11 can enter a circumferential groove of a sleeve located around the external conductor 5 (not illustrated) and enter recesses 15 (compare for example FIGS. 1, 2 and 9) of the housing 4 of the plug-in connector 2 by means of one or more latching lugs 14 (compare FIG. 8) and therefore secure the housing 4 of the plug-in connector 2 to the sleeve encasing the external conductor 5.

Figure 4:
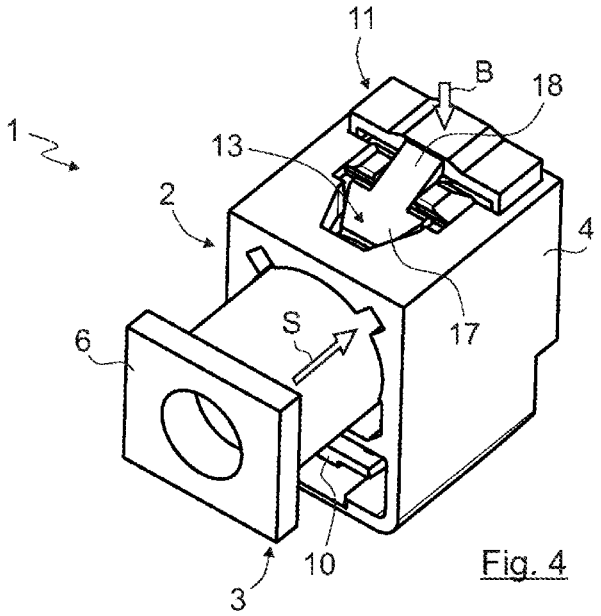
FIG. 4 is a perspective illustration of the plug-in connector of FIG. 3 together with the electrical mating plug-in connector in a state in which they are not yet plugged together.

The securing element 12 can be movable, by a closing movement B, from a preliminary latching position (compare FIGS. 3 to 5) to a locking position (compare FIG. 6 and FIG. 7) in which the securing element 12 mechanically secures the plug-in connection 1.

The closing movement B is a linear movement and runs preferably orthogonally to the insertion direction S of the plug-in connection 1. The plug-in prevention means 13 can be pivoted radially outward from a center axis M of the plug-in connector 2 in order to clear the displacement path of the mating plug-in connector 3 into the plug-in connector 2.

In this case, the securing element 12 is operatively connected to the plug-in prevention means 13 in such a way that the plug-in prevention means 13 can be moved, during the closing movement B of the securing element 12, from a home position (compare for example FIG. 5), in which the plug-in prevention means 13 blocks complete insertion of the mating plug-in connector 3 into the plug-in connector 2, to a clearing position (compare for example FIG. 7), in which the plug-in prevention means 13 clears the displacement path between the mating plug-in connector 3 and the plug-in connector 2 for complete insertion of the mating plug-in connector 3 into the plug-in connector 2.

Figure 5:
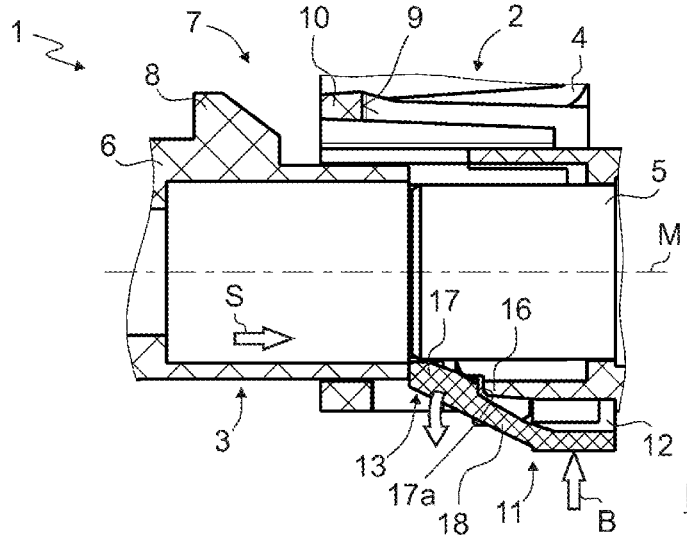
FIG. 5 is a sectional illustration, rotated through 180°, of the electrical plug-in connection illustrated in FIG. 4.
Figure 6:
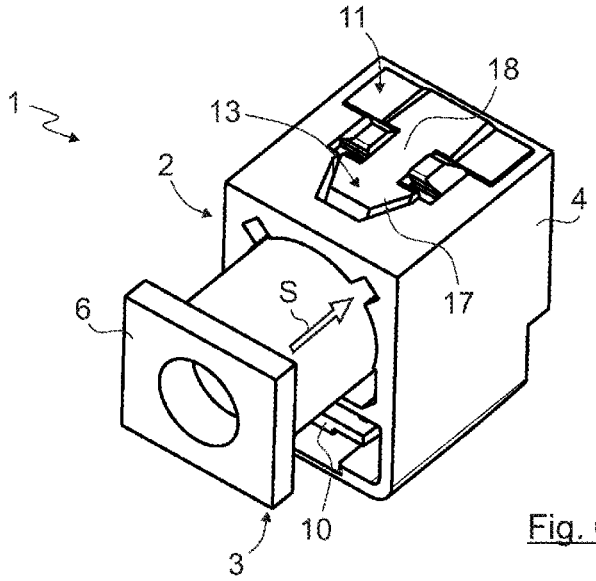
FIG. 6 is a perspective illustration of the electrical plug-in connection illustrated in FIG. 4 with the secondary securing means in the locking position.
Figure 7:
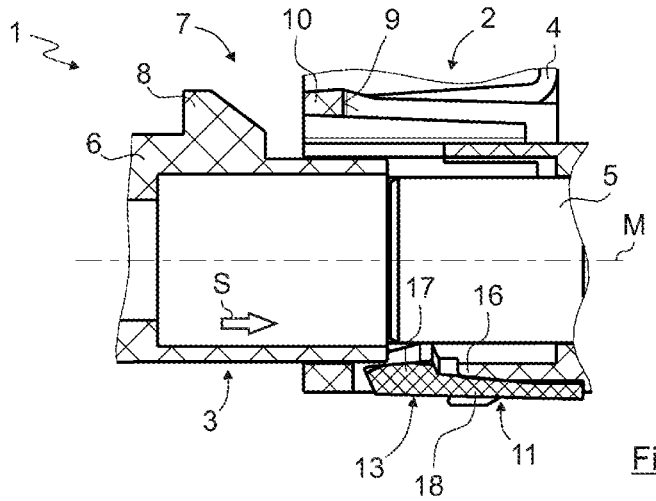
FIG. 7 is a sectional illustration, rotated through one hundred eighty degrees (180°), of the electrical plug-in connection illustrated in FIG. 6.

According to a first embodiment, which is illustrated in FIGS. 3 to 8, the plug-in prevention means 13 can be moved in a rotational manner from the home position to the clearing position along a supporting element 16 (compare FIG. 5 and FIG. 7).

The plug-in prevention means 13 has a stop head 17 for blocking the mating plug-in connector 3 and a deformable, preferably elastic, spring arm 18 which extends from the stop head 17 in the direction of the supporting element 16. In the exemplary embodiment, the supporting element 16 is formed as an edge of a recess in the housing 4 of the plug-in connector 2, wherein the spring arm 18 is supported on the edge of the recess. As a result, the plug-in prevention means 13 or at least its stop head 17 can be pivoted out of the displacement path of the mating plug-in connector 3 when the securing element 12 or the secondary securing means 11 is linearly operated. The principle is demonstrated, in particular, when FIGS. 5 and 7 are looked at together.

The stop head 17 is designed in a reinforced manner in comparison with the spring arm 18. The stop head is preferably supported, by way of a supporting area 17*a*, on the edge 16, so that forces, which act on the stop head 17 in the event of undesired insertion of the mating plug-in connector 3, are introduced into the plug-in connector 2 via the edge 16.

The plug-in prevention means 13 can preferably be supported on the external conductor 5 in the home position, in which the plug-in prevention means 13 blocks insertion of the mating plug-in connector 3 into the plug-in connector 2, as illustrated in FIG. 5. The electrical external conductor 5 of the plug-in connector 2 is preferably designed as a Koshiri ring in order to prevent damage to the external conductor 5 when the mating plug-in connector 3 is inserted at an angle.

Figure 9:
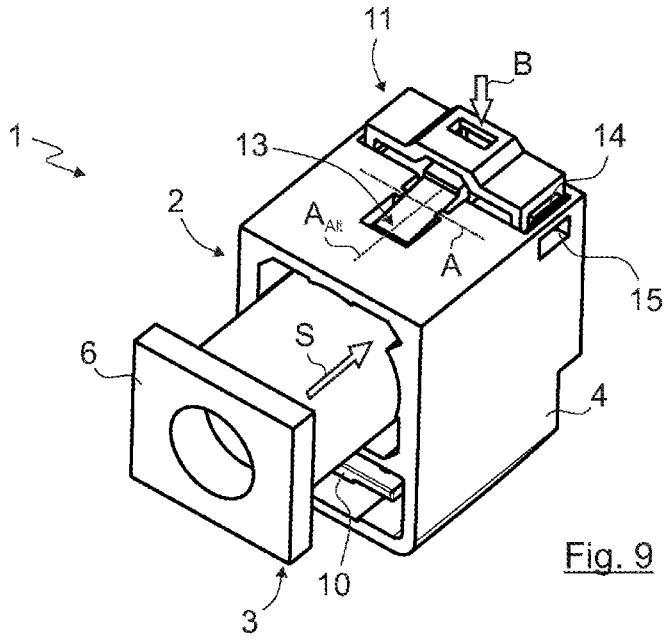
FIG. 9 is a perspective illustration of a second embodiment of the plug-in connection according to the invention with a secondary securing means in the preliminary latching position.
Figure 10:
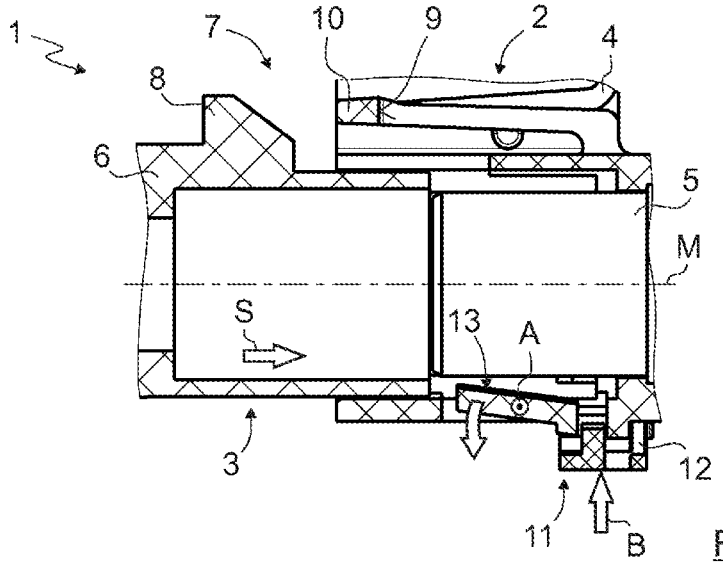
FIG. 10 is a sectional illustration, rotated through one hundred eighty degrees (180°), of the electrical plug-in connection illustrated in FIG. 9.

According to a second embodiment of the invention, provision can also be made for the plug-in prevention means 13 to be able to be moved in a rotational manner in the form of a rocker from the home position to the clearing position via a rotation axis A, as illustrated in FIGS. 9 and 10.

In this case, the rotation axis A can be formed by a rotary joint of the housing 4 of the plug-in connector 2. In the exemplary embodiment, the rotation axis A runs orthogonally to the insertion direction S of the mating plug-in connector 3 into the plug-in connector 2. However, the rotation axis can also run parallel to the insertion direction S of the mating plug-in connector 3 in principle, as is indicated in FIG. 9 by illustration of an alternative rotation axis $A,A_{Alt}$.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. A secondary securing means for locking an electrical plug-in connection of a first electrical plug-in connector and a mating electrical plug-in connector, which mating electrical mating plug-in connector inserts along a displacement path into the first electrical plug-in connector, said secondary securing means comprising:

a securing element and a plug-in prevention means, the securing element being movable, by a closing movement, from a preliminary latching position to a locking position, the locking position being a position in which the securing element mechanically secures the first electrical plug-in connector to the mating electrical plug-in connector to lock the electrical connection with the mating electrical plug-in connector inserted completely into the first electrical plug-in connector, the securing element being operatively connected to the plug-in prevention means in such a way that, during the closing movement, the plug-in prevention means is movable from a home position to a clearing position, the home position being a position, in which the plug-in prevention means blocks complete insertion of the mating electrical plug-in connector into the first electrical plug-in connector the clearing position being a position in which in which the plug-in prevention means clears the displacement path to allow complete insertion of the mating electrical plug-in connector into the first electrical plug-in connector, the plug-in prevention means being movable from the home position to the clearing position by a rotational movement of the plug-in prevention means.

2. A secondary securing means as claimed in claim 1, wherein the plug-in prevention means clears the displacement path by being moved radially outward from a center axis of the first electrical plug-in connector.

3. A secondary securing means as claimed in claim 1 wherein, the first electrical plug-in connector has a housing which includes a supporting element and wherein the rotational movement of the plug-in prevention means is a movement along the supporting element.

4. A secondary securing means as claimed in claim 1, wherein the closing movement of the securing element is a linear movement.

5. A secondary securing means as claimed in claim 4, wherein the closing movement of the securing element is orthogonal to an insertion direction in which the mating electrical plug-in connector inserts into the first electrical plug connector.

6. A secondary securing means as claimed in claim 1 wherein, the rotational movement of the plug-in prevention means is a rotational movement about a rotational axis.

7. An electrical plug-in connector as claimed in claim 6, wherein the rotation axis is orthogonal to an insertion direction in which the mating plug-in connector inserts into the electrical plug-in connector.

8. An electrical plug-in connector for connection to an electrical mating plug-in connector which inserts into the electrical plug-in connector by way of a displacement path, said electrical plug-in connector comprising:

a housing and a plug-in prevention means, the plug-in prevention means being movable between a home position and a clearing position, the home position being a position at which the plug-in prevention means blocks complete insertion of the mating plug-in connector into the electrical plug-in connector, the clearing position being a position at which the plug-in prevention means clears the displacement path allowing complete insertion of the mating plug-in connector into the electrical plug-in connector, the plug-in prevention means being movable from the home position to the clearing position by a rotational movement of the plug-in prevention means, the electrical plug-in connector further comprising an electrical external conductor which has a Koshiri ring.

9. An electrical plug-in connector as claimed in claim 8, wherein in the home position the plug-in prevention means is supported on the external conductor.

10. An electrical plug-in connector as claimed in claim 8, wherein, the rotational movement of the plug-in prevention means is a rotational movement about a rotational axis and wherein the rotational axis is formed by a rotary joint of the housing of the plug-in connector.

11. An electrical plug-in connector as claimed in claim 8, wherein the rotation axis is parallel to an insertion direction in which the mating plug-in connector inserts into the electrical plug-in connector.

12. An electrical plug-in connector as claimed in claim 8, wherein the plug-in prevention means forms, together with a securing element, a secondary securing means for locking an electrical plug-in connection which electrical plug-in connection consists of the electrical plug-in connector a mating electrical plug-in connector.

13. A secondary securing means as claimed in claim 8, wherein, the rotational movement of the plug-in prevention means is a rotational movement about a rotational axis.

14. An electrical plug-in connector as claimed in claim 8, wherein the housing of the electrical plug-in connector includes a supporting element, the plug-in prevention means has a stop head for blocking the complete insertion of the mating electrical plug-in connector into the electrical plug-in connector and wherein the plug-in prevention means also has a deformable spring arm which extends from the stop head toward the supporting element.

15. An electrical plug-in connector as claimed in claim 14, wherein, the electrical plug-in connector has a housing which includes a recess and the recess has an edge which forms the supporting element.

16. An electrical plug-in connector as claimed in claim 15, the spring arm is supported on the edge of the recess.

* * * * *